United States Patent [19]

Gasser

[11] Patent Number: 4,646,951

[45] Date of Patent: Mar. 3, 1987

[54] BLANK FOR A NECKTIE HOLDER

[75] Inventor: Monika Gasser, Dübendorf, Switzerland

[73] Assignee: Arthur Gasser, Switzerland

[21] Appl. No.: 725,424

[22] Filed: Apr. 22, 1985

[51] Int. Cl.[4] ..... A47G 25/74; B65D 85/18

[52] U.S. Cl. ..... 223/87; 223/DIG. 1; 206/292; 206/299; 206/806

[58] Field of Search ..... 223/DIG. 1, DIG. 2, 223/87, 85; 206/278, 281, 283, 284, 285, 289, 292, 293, 294, 296, 299, 806

[56] References Cited

U.S. PATENT DOCUMENTS

| | | | |
|---|---|---|---|
| 2,682,122 | 6/1954 | Hanson | 206/278 |
| 3,329,386 | 7/1967 | Rosen | 223/87 |
| 3,370,765 | 2/1968 | Jossem | 223/87 |
| 3,456,853 | 7/1969 | Hodge | 223/87 |

FOREIGN PATENT DOCUMENTS

| | | | |
|---|---|---|---|
| 214484 | 4/1958 | Australia | 223/87 |
| 2333709 | 7/1977 | France | 206/299 |

*Primary Examiner*—Louis K. Rimrodt
*Assistant Examiner*—Joseph S. Machuga
*Attorney, Agent, or Firm*—Ostrolenk, Faber, Gerb & Soffen

[57] ABSTRACT

A necktie display holder and the blank therefor is formed which makes it possible to display an individual necktie in more striking fashion to a customer, particularly if the tie is in knotted state. Such a blank has a rear part which is separated by a fold line from a front part. A hanger which is held on the base is stamped out from the rear part. Two arms which protrude laterally from the front part and can be folded towards each other and connected to each other are provided in order to hold the necktie fast. The front part and the rear part are of similar shape. The front part has a triangular cutout so that the necktie and particularly the knot when the tie is knotted are visible. The two arms are provided with complementary incisions so that they can be interconnected to hold the display holder together.

1 Claim, 3 Drawing Figures

BLANK FOR A NECKTIE HOLDER

BACKGROUND OF THE INVENTION

The present invention relates to a display holder for a necktie holder and to the blank for forming said holder.

In stores and mens' shops, neckties are most often either laid out flat or hung from a ring-shaped stand. This kind of display does not permit an individual presentation which will impress the viewer. In particular, the neckties cannot thus be presented in knotted condition.

SUMMARY OF THE INVENTION

The object of the present invention is to create a necktie holder and a blank for forming the same which makes it possible to display an individual necktie to the customer in more striking fashion, particularly in those cases where the necktie is knotted.

In carrying out the present invention, the blank which is to form the holder has the following salient novel elements:

a rear part which is separated by a fold from the front part;

a hanger which is stamped out of the rear part and connected at its base to the rear part; and two arms which protrude laterally from the front part, and can be folded towards each other and connected to each other in order to hold the necktie fast.

The foregoing objects and features of the invention will become apparent in the following description and drawings.

DETAILED DESCRIPTION OF THE PREFERRED EMBODIMENTS

Figure 2:
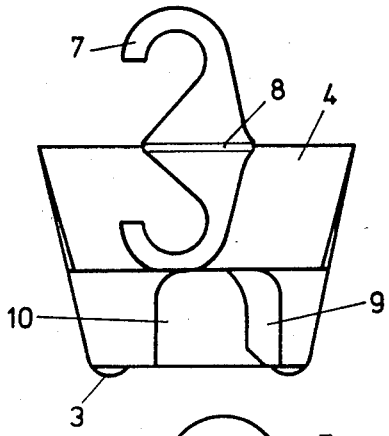
FIG. 2 is a rear view of the blank of FIG. 1 folded and connected to form a necktie holder ready for hanging.

Referring now to the drawings, the blank 1, which is made from a single piece of cardboard or the like, has a front part 3 and a rear part 4 which are of similar shape. The two parts 3 and 4 are separate from each other and are joined by a fold 5 which forms the top of the holder of FIG. 3. A hanger in the form of a hook 7 is stamped out from the rear part 4 so that it can be bent out of the rear part 4 into the position shown in FIG. 2. The base 8 of the hanger hook 7 is, of course, not cut so that the hook 7 will remain connected to the holder.

Figure 1:
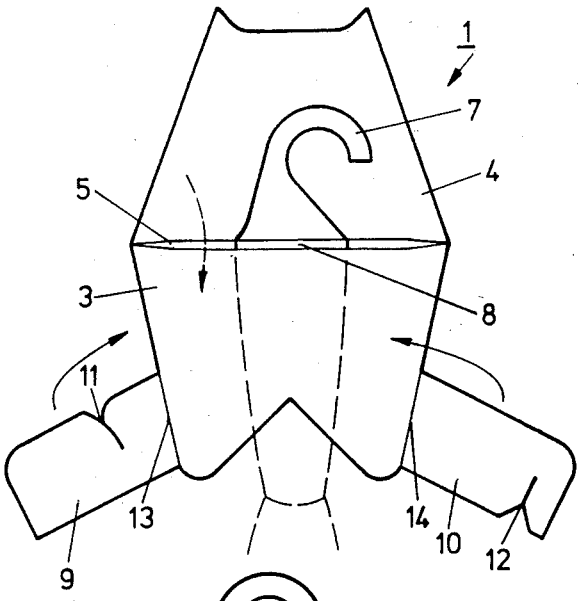
FIG. 1 is a plan view of the blank in open condition with the necktie indicated in dashed lines.
Figure 3:
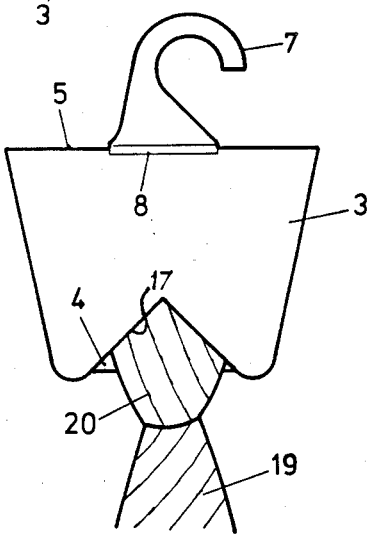
FIG. 3 is a front view of the embodiment shown in FIG. 2, with a knotted necktie carried thereby.

Arms 9 and 10 protrude from the opposite sides of the front part 3. The two arms 9 and 10 act to urge back panel 4 toward front panel 3 to provide a friction fit for the tie between the two side panels. These arms are provided with complementary incisions 11 and 12, respectively, and can be folded inward over folds 13, 14. The front part 3 is provided with a triangular cutout 17 which, when the blank is folded and the necktie is introduced, allows the upper part of the necktie, and particularly the knot of the necktie, to be clearly visible. FIG. 3 shows a necktie 19 having the knot 20. As can be noted from FIG. 1, this necktie is clamped fast by the two arms 9 and 10 after the latter have been inserted between the folded parts 3 and 4. However, the necktie can be easily removed from the holder and again introduced into it in the manner described and can be suitably displayed by hanging it up by means of the hook 7.

The front and rear parts, as well as their insides, can be printed, for instance with advertisements, instructions for use, instructions for cleaning, etc.

In the foregoing, the present invention has been described in connection with an illustrative embodiment. Since many variations and modifications can now be obvious to those skilled in the art, it is preferred that the scope of this invention be determined, not merely by the specific embodiments herein disclosed, but only by the appended claims.

What is claimed is:

1. A display holder for a necktie comprising:

a front section and a rear section;

a fold line connecting the front and rear sections; said front and rear sections being capable of supporting a knotted necktie therebetween; said necktie being removable from between said front and rear sections;

interlocking securement for said front and rear sections;

said interlocking sections comprising a pair of arms each extending from the opposite sides of said front section and foldable to interlock behind said rear section;

a hanging hook being formed by excising said hook from said rear section and permitting said hook to remain connected at said fold line between the front and rear sections;

said front section being cut out in a shape to display the knot of said necktie.

* * * * *